US006185979B1

(12) United States Patent
Schöllhammer

(10) Patent No.: US 6,185,979 B1
(45) Date of Patent: Feb. 13, 2001

(54) TRAVERSE-TYPE THREE-AXIS TRANSFER SYSTEM

(75) Inventor: Dietmar Schöllhammer, Göppingen (DE)

(73) Assignee: Schuler Pressen GmbH & Co. KG, Göppingen (DE)

( * ) Notice: Under 35 U.S.C. 154(b), the term of this patent shall be extended for 0 days.

(21) Appl. No.: 09/305,200

(22) Filed: May 5, 1999

(30) Foreign Application Priority Data

May 5, 1998 (DE) ..... 198 19 965

(51) Int. Cl.[7] ..... B21D 43/05

(52) U.S. Cl. ..... 72/405.16; 72/405.13; 198/621.1

(58) Field of Search ..... 72/405.13, 405.16, 72/405.11, 405.09, 405.01; 198/621.1; 414/751

(56) References Cited

U.S. PATENT DOCUMENTS

| | | | | |
|---|---|---|---|---|
| 4,688,668 | | 8/1987 | Ookubo et al. | 198/621 |
| 5,159,827 | | 11/1992 | Shiraishi et al. | 72/405 |
| 5,595,087 | * | 1/1997 | Harsch | 72/405.13 |
| 5,775,163 | * | 7/1998 | Riedisser | 72/405.12 |
| 5,937,693 | * | 8/1999 | Endou | 72/405.16 |

FOREIGN PATENT DOCUMENTS

| | | | | |
|---|---|---|---|---|
| 59-163038 | * | 9/1984 | (JP) | 72/405.01 |
| 61074740 | | 4/1986 | (JP) . | |
| 62-9730 | * | 1/1987 | (JP) | 72/405.13 |

* cited by examiner

*Primary Examiner*—Daniel C. Crane
(74) *Attorney, Agent, or Firm*—Evenson, McKeown, Edwards & Lenahan, P.L.L.C.

(57) ABSTRACT

A transfer system is provided for press facilities with several successive press stations. The transfer system has divided cross traverses which, with respect to the transport direction, can be moved from the front and the rear into the tool. Each tool includes two respectively transversely divided traverses. For receiving and depositing the workpieces, the cross traverses are adjusted toward and away from one another. In addition, when the tool is closed, the cross traverse are laterally moved past the tool. As required, they may be changed for this purpose into an overtaking position, which can be carried out, for example, by a swivel drive. The transfer system permits a shortening of the minimum time for which the tools must be open with respect to the transfer system and thus allows an increase of the stroke number of the press.

18 Claims, 6 Drawing Sheets

TRAVERSE-TYPE THREE-AXIS TRANSFER SYSTEM

This application claims the priority of 198 19 965.1, filed May 5, 1998, the disclosure of which is expressly incorporated by reference herein.

BACKGROUND AND SUMMARY OF THE INVENTION

The present invention relates to a transfer system for multi-station presses and/or press working lines.

In for example, multi-station presses or press working lines, transfer systems have the task of transporting sheet metal parts or other workpieces from one press station to another. A workpiece passes successively through all press stations. The transfer system has the task of moving the opening tool over, i.e. below the top tool lifting off the workpiece, of picking up the workpiece, of moving it into the still open tool of the next press station and of depositing the workpiece there. Before the top tool is placed on the workpiece, the corresponding part of the transfer system must have been moved out of the tool.

During this operation, the gripper devices of the transfer system must cover considerable distances and move relatively large masses. Particularly with large-part presses, vehicle body presses and comparable facilities, very high accelerations and braking decelerations result and cannot easily be infinitely increased when the running speed (stroke number) of the press is to be raised.

EP 0388610 B1 describes a press facility which has a two-axis transfer system. The transfer system has two running rails which extend on both sides of the tools along the entire length of the press facility and on which travelling carriages are disposed. The running rails are connected with lifting devices which move the running rails synchronously up and down in the timing of the hybrid press facility. Two mutually opposite travelling carriages respectively are connected with one another by suction bridges or cross traverses. These are provided with vacuum suction devices so that a workpiece can be taken up and deposited in a controlled manner. By way of a transport linkage, the travelling carriages are connected with a drive to provide them with a longitudinal movement. By superimposing the lifting and lowering movement of the running rails on the longitudinal movement of the travelling carriages, the suction bridges negotiate the desired transfer curve by which the parts are transported.

When the tools close, the suction bridges must stand between the tools. Because of the finite moving and transporting speed of the suction bridges, this means that a maximal number of strokes cannot be exceeded. With smaller press strokes, higher stroke numbers are frequently desirable.

In addition, so-called three-axis transfer systems are known, in which, instead of the running rails, transfer bars are provided. In addition to the lifting and lowering movement, the transfer bars can also carry out a transfer movement in the transport direction and an opening and closing movement laterally with respect to the transport direction. The transfer bars carry blades which can reach laterally under the sheet metal parts.

Transfer systems of this type can carry out, for example, a return stroke when the tools of the individual press stations are closed. In the third axis, the blades held on the transfer bars carry out a lateral escape movement and move laterally past the closed tools. However, the blades grip the workpieces only on the edge. For this type of parts transport, the stability of the workpieces must therefore be sufficiently high. If parts are separated in a press station, i.e., if two sheet metal parts are cut out of a blank which are to be transported, e.g., side-by-side, the parts transport cannot be carried out only by means of the blades which reach into the tools from the sides. This limits the application possibilities of the three-axis transfer system.

SUMMARY OF THE INVENTION

An object of the present invention is to provide a transfer system which permits high stroke numbers of the presses and a high flexibility.

This object has been achieved by a transfer system having at least one transfer carrier extending along at least two press stations, workpiece receiving devices operatively arranged to interact for receiving a workpiece, the workpiece receiving devices being carried by the transfer carrier and arranged to be moved toward one another into a workpiece receiving position, and away from one another into a workpiece-release position.

The transfer system according to the invention has at least one transfer carrier which moves past several tools and on which at least two workpiece receiving devices are provided. These can be moved toward one another and away from one another in order to pick-up and release a workpiece. For the transport of the workpiece, the workpiece receiving devices are advanced one more tool position. The transfer curve covered in this manner has two components, namely a lifting/lowering movement and a translational movement. The movement of the workpiece receiving devices toward one another and away from one another represents a third movement component, whose direction preferably coincides with the direction of the translational movement.

The transfer system of the present invention permits shortened transfer times and therefore higher stroke numbers. The shortening of the transfer times is the result of the minimizing of the required moving path for picking up and depositing the parts. While conventional suction bridges must be moved a long distance to the tool center into the opening tool, in the case of the transfer system according to the invention, the short-distance moving of the receiving devices into the opening tool can be started relatively early. The moving-in path amounts is short, for example, only a few centimeters.

A further saving of transfer time is achieved by the possibility of positioning the receiving devices in a preparatory manner for the subsequent transfer step during the press stroke, i.e., when the tools are closed. While, with a conventional two-axis transfer system with cross traverses (suction bridges), during the working stroke of the press station, the cross traverse must stand in a waiting position therebetween, the receiving devices of the transfer system according to the invention can be guided past the closing or closed tools. A portion of the required path to be covered by the receiving devices can therefore be covered during the working stroke of the press, which saves a considerable amount of time. Particularly when the presses are set to a low stroke, this permits the carrying-out of high stroke numbers.

In their receiving movement, the receiving devices are aligned toward and away from one another in the transport direction. As a result, the receiving devices can hold a front and a rear edge of the workpiece with respect to the transport direction. In contrast to holding devices which are applied laterally to the workpiece, the transfer of less stable parts and, in the case of a corresponding setup, also the transfer of parts guided in parallel through the press stations is permitted. This results in multiple application possibilities.

In a preferred embodiment, the workpiece receiving devices can be changed not only into a workpiece receiving position and a workpiece release position but also into an overtaking position which allows or facilitates the moving of the workpiece receiving devices past closed tools. This provides the basis for workpiece receiving devices which are relatively wide in the transverse direction. For the movement past closed tools, these can be folded for example, in the longitudinal direction or in the vertical direction but definitely into a position in which they require only very little space in the lateral direction. In addition to swivelling and folding movements, telescopable devices or the like can be used. The large transverse dimension of the receiving devices situated in the workpiece receiving position is particularly suitable for handling several parts guided in parallel or instable parts.

Swivel arms can, for example, also be used as receiving devices which, in each case at one end, are swivellably disposed on the transfer carrier. For receiving the workpiece, the swivel arms are swivelled toward one another until they are aligned parallel to one another. They are then in the workpiece-receiving position and have picked up a workpiece. For the release, the swivel arms are swivelled away from one another until they are aligned at an acute angle or parallel to the transfer carrier. They are now in the workpiece-release position which, in this embodiment, corresponds to the overtaking position. The advantage of this embodiment is the fact that, for the opening and closing of the workpiece receiving devices, i.e., for the movement between the workpiece-receiving position and the workpiece-release position, and for the positioning of the workpiece-receiving devices into the overtaking position, only a single driving device is required for each pair of receiving devices.

In principle, the basic concept of the invention can be implemented on a transfer system with only one transfer carrier. In press working lines or multi-station presses of a larger dimension, however, a symmetrical construction is considered to be advantageous, in which two transfer carriers with corresponding receiving devices are provided which are arranged on both sides of the workpieces or tools. The transfer carriers and their receiving devices are preferably constructed mirror—invertedly with respect to a longitudinal-vertical plane.

In the symmetrical embodiment, the workpiece-receiving devices can be considered as cross traverses which are divided in the center and which, in comparison to conventional continuous cross traverses, have the main advantage that they can be guided past closed tools. However, similarly to conventional cross traverses (suction bridges), they permit the handling of large-surface parts which may also have low stability.

Basically, the receiving devices can be arranged on travelling carriages, with the transfer carriers then being used as running rails which are only still lifted and lowered. The advantage here is a relative reduction of the masses to be moved in the longitudinal direction.

Alternatively, the longitudinal component of the transfer movement can also be carried out by the transfer carriers which, as a result, transport the workpiece-receiving devices in the longitudinal direction. In this embodiment, the receiving devices are moved relative to the transfer carriers only for carrying out the workpiece-receiving movement or the workpiece-release movement. For this purpose, controllable driving devices, such as drives, are arranged between the workpiece-receiving devices and the longitudinal carriers, which drives permit a relatively short-stroke relative movement between the workpiece-receiving devices and the longitudinal carrier and otherwise connect the workpiece-receiving devices with the longitudinal carrier. Blades, grippers or suction devices can be used as receiving devices. Blades are distinguished by their simplicity and by the possibility of already moving into an only slightly opened tool.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWINGS

Figure 1:
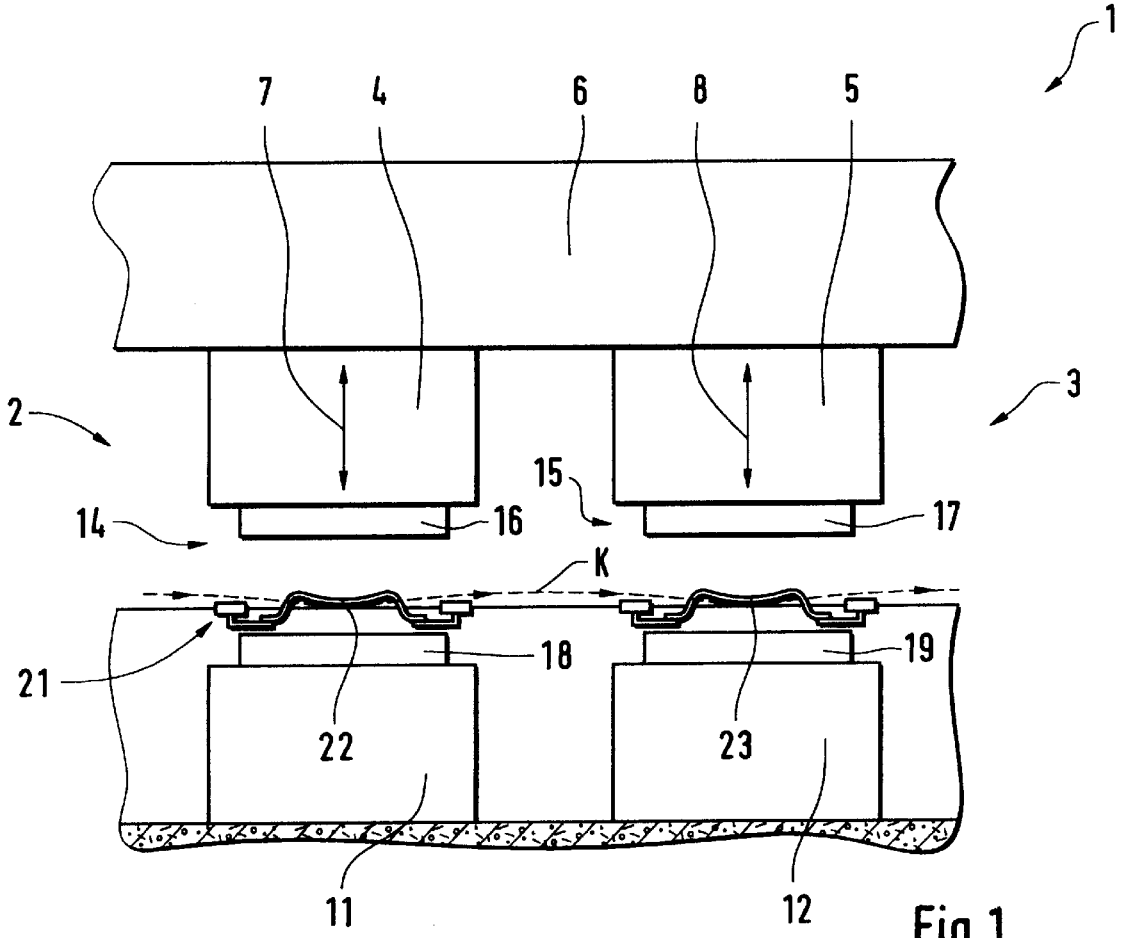
FIG. 1 is a schematic side view of a press facility with several press stations and a transfer system for the parts transport.

FIG. 1 illustrates a press facility 1 with several press stations, of which only two press stations 2, 3 need be shown to illustrate the present invention. Each press station 2, 3 includes one slide 4, 5 respectively which is driven up and down by a main drive which is arranged in a press head or crown 6. The slide movement is illustrated in FIG. 1 by arrows 7, 8.

Bedplates 11, 12 are arranged below the slides 4, 5. A forming tool 14, 15 is arranged in each press station 2, 3, and includes one top tool 16, 17 respectively held on the slide 4, 5 as well as a bottom tool 18, 19 disposed on the bedplate 11, 12.

A transfer system 21 has the purpose of transporting sheet metal parts 22 through the press stations 2, 3. The sheet metal parts 22, 23 cover a path which is determined by a transfer curve K. In FIG. 1, the transfer curve K is indicated by a broken line.

Figure 2:
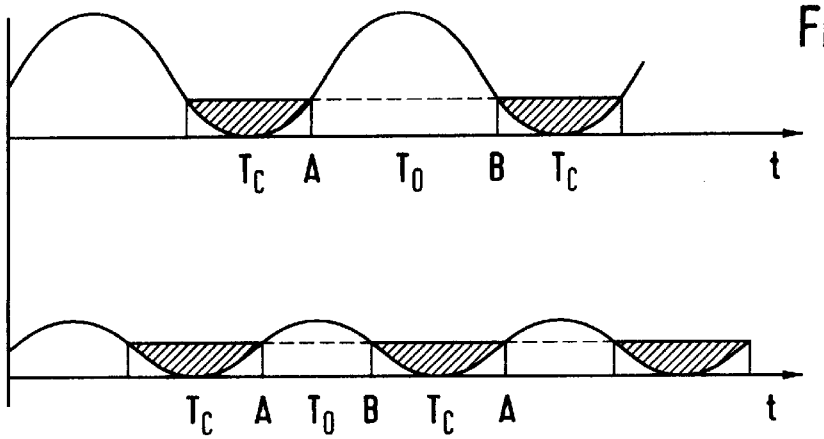
FIG. 2 is a graph of time sequences of the slide movement with different strokes and stroke numbers.

When the tools 14, 15 are at least partially opened up, the sheet metal parts 22, 23 can be taken out of the tools 14, 15 and inserted thereinto. This is illustrated in FIG. 2 which illustrates the course of the movement of the slides 4, 5 over the time at different stroke widths and stroke numbers. In the upper part of FIG. 2, the slides 4, 5 carry out an almost sinusoidal stroke movement of a high amplitude and a relatively low stroke number. The areas in which the tools 14, 15 are almost closed, that is, the top tools 16, 17 are partially or completely placed on the workpieces 22, 23, are illustrated as hatched time segments $T_c$. During these time segments, all parts of the transfer system 21 must have been moved out of the tools 14, 15. Between the closing times $T_c$, time intervals $T_o$ are available in which the workpieces 22, 23 are accessible and can be moved out of the tools 14, 15 or moved thereinto.

In order to be able to move grippers or other devices into the tools 14, 15, a minimum opening is required. If the stroke of the transfer press is now reduced, the time period $T_o$, in which the tools 14, 15 are sufficiently opened up, is reduced considerably. If the stroke number is now also increased, which seems definitely possible because of the lower stroke, the time in which the tools 14, 15 are open is reduced further. This is illustrated on the bottom of FIG. 2.

Figure 3:
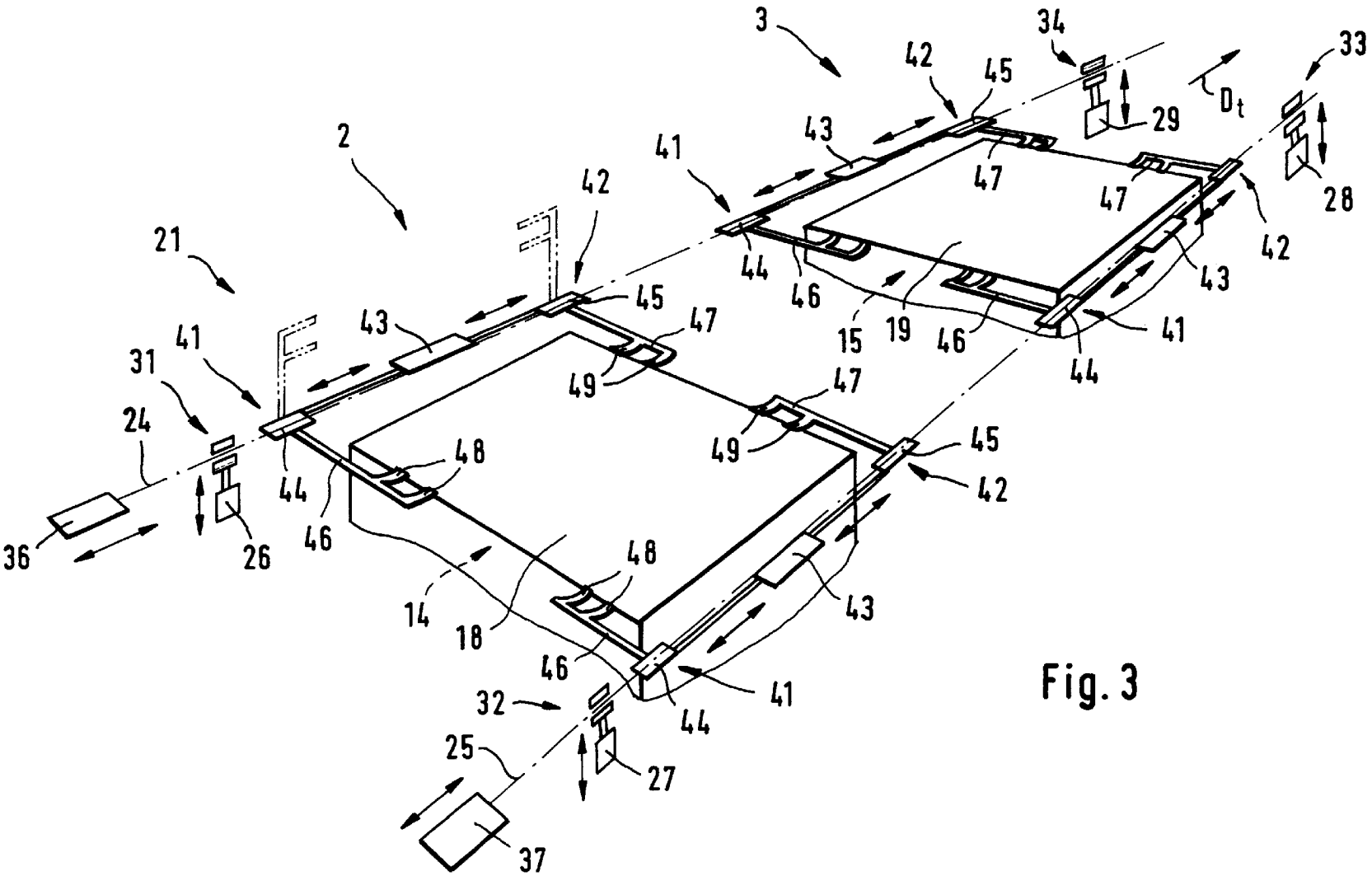
FIG. 3 is a schematic perspective view of the transfer system of the press facility of FIG. 1.

The present transfer system 21 according to the invention, whose basic construction is illustrated in FIG. 3, takes this shortened open time of the tools into account. The transfer system 21 has two transfer carriers 24, 25, which are spaced parallel to one another and which are arranged on both sides of the tools 14, 15 in the transfer direction $D_t$. In the illustrated embodiment, the transfer carriers 24, 25 are connected with lifting units 26, 27, 28, 29, which are synchronously controlled and provide the transfer carriers 24, 25 with a lifting and lowering movement synchronously to the working cycle of the slides 4, 5 defined by the main drive of the press. This lifting and lowering movement represents the vertical component of the transfer curve K.

The transfer carriers 24, 25 are held by the lifting units 26 to 29 in linear guides 31, 32, 33, 34 which permit a longitudinal movement of the transfer carriers 24, 25. In order to travel through these in a targeted manner, the transfer carriers 24, 25 are connected with transfer drives 36, 37 which are driven synchronously with the slides 4, 5 of the press facility 1. They provide the transfer carriers 24, 25 with the longitudinal component of the transfer curve K.

At the press station 2, the transfer carrier 24 carries two travelling carriages 41, 42 which can be adjusted toward and away from one another at least by a stroke measuring several centimeters. The travelling carriages 41, 42 are non-rotatably disposed on the transfer carrier 24. In order to adjust them toward and away from one another, the transfer carrier 24 carries an adjusting drive 43 which is connected by corresponding transmission devices, such as rods, with the travelling carriages 41, 42 in order to adjust these in a defined manner with respect to the transfer carrier 24.

In addition, the travelling carriages 41, 42 are provided with a swivel drive 44, 45 which carries one extension arm 46, 47 respectively. The mutually permanently parallel extension arms 46, 47 can be swivelled by controlling the swivel drive 44, 45 into the horizontal position illustrated by solid lines and into the vertical position illustrated by broken lines. For receiving the workpieces 22, 23, the extension arms 46, 47 are equipped with blades 48, 49.

On the corresponding opposite side, the transfer carrier 25 is also provided with travelling carriages 41, 42 and with an adjusting drive 43. The travelling carriages 41, 42 carry swivel drives 44, 45 which, in turn, hold the extension arms 46, 47 which are equipped with blades 48, 49.

At the next press station 3, the transfer carriers 24, 25 are also provided with travelling carriages 41, 42 adjusting drives 43, swivel drives 44, 45 and extension arms 46, 47 with blades 48, 49. The control of all adjusting drives 43 and all swivel drives 44, 45 takes place synchronously at least when the slides 4, 5 move synchronously. The adjusting drives 43 and the swivel drives 44, 45 may be electric drives, hydraulic drives or pneumatic drives.

Figure 4:
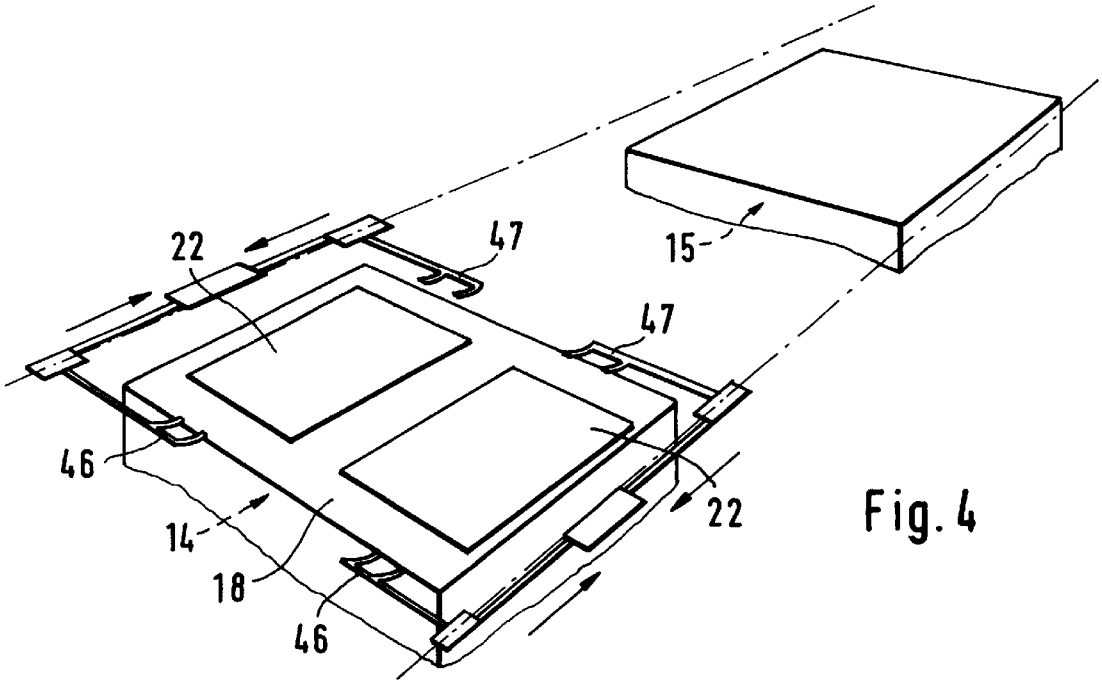
FIGS. 4 to 11 are views of the transfer system similar to FIG. 3 but in different operating stages.

For picking up a workpiece while the tool is opening up, at a point in time A (FIG. 2), every adjusting drive 43 is controlled such that the extension arms 46, 47, which are already standing laterally beside the tool 14, 15, are adjusted toward one another. In this operation, the blades 48, 49 move under and pick up the workpiece. The extension arms 46, 47 are therefore changed from their workpiece-release position into a workpiece-receiving position as illustrated in FIG. 4.

Figure 5:
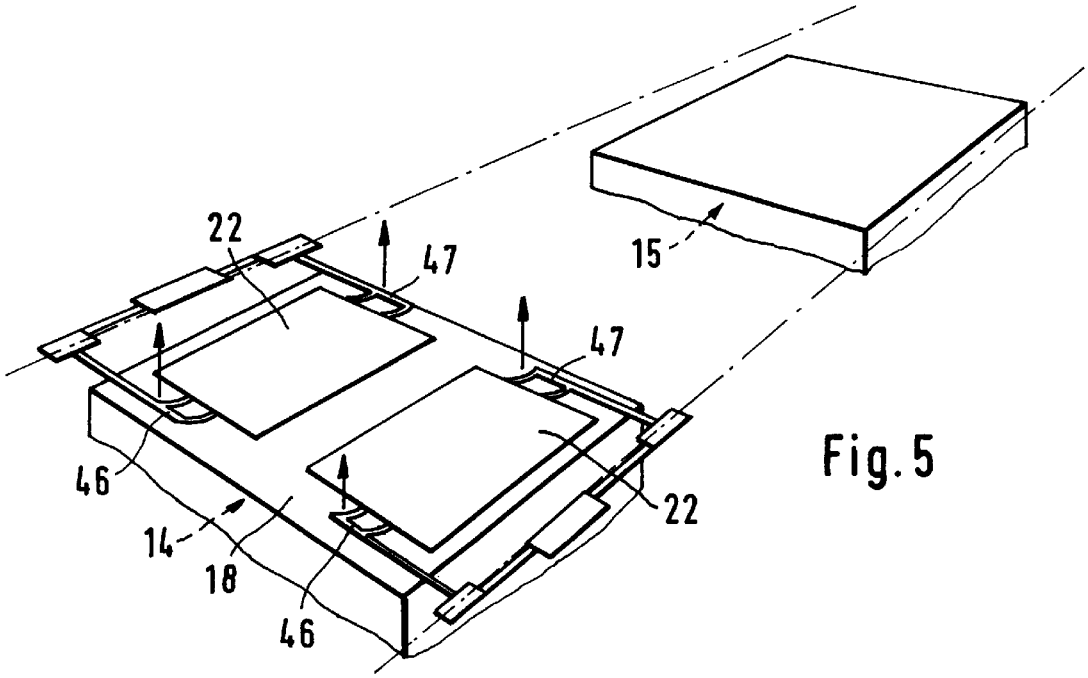
Figure 6:
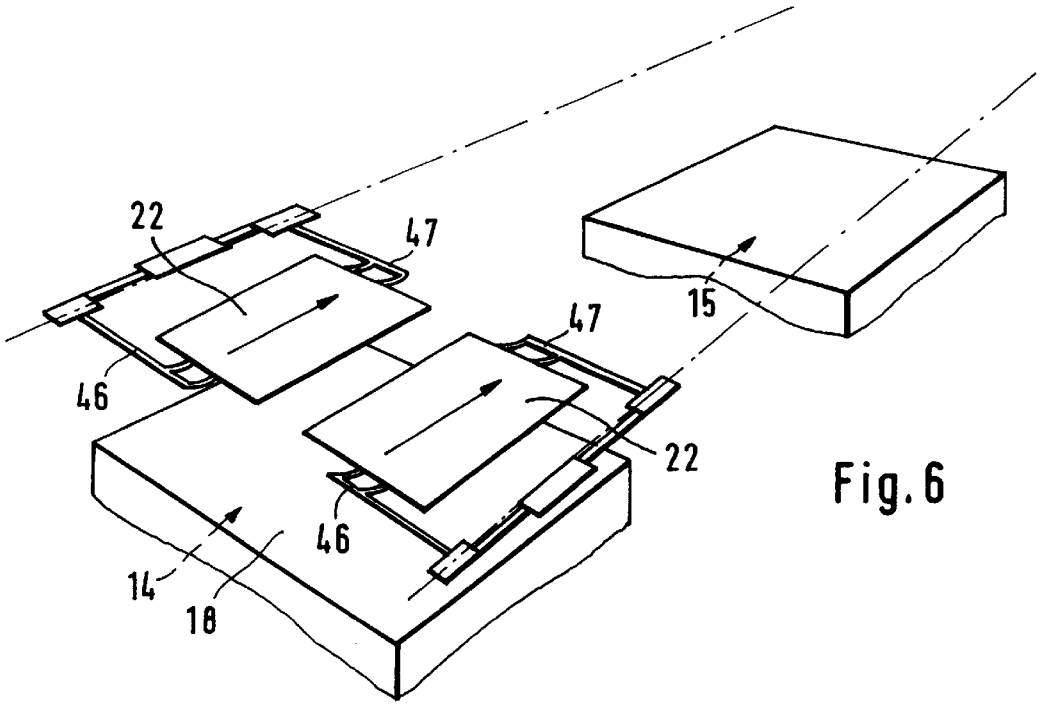
Figure 7:
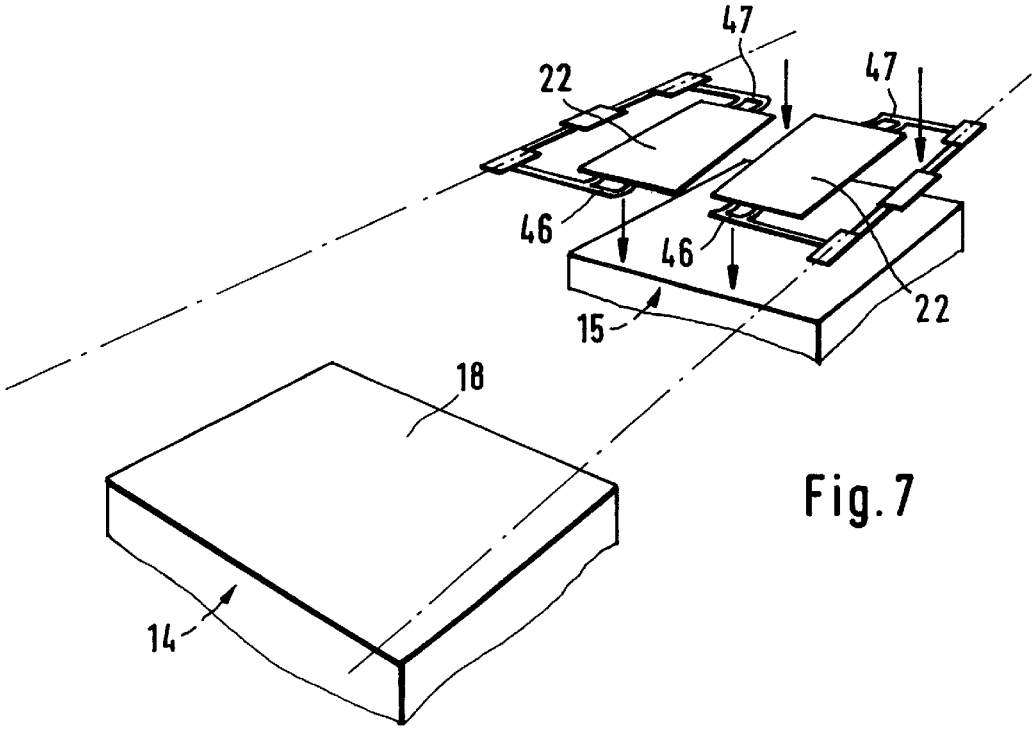
Figure 8:
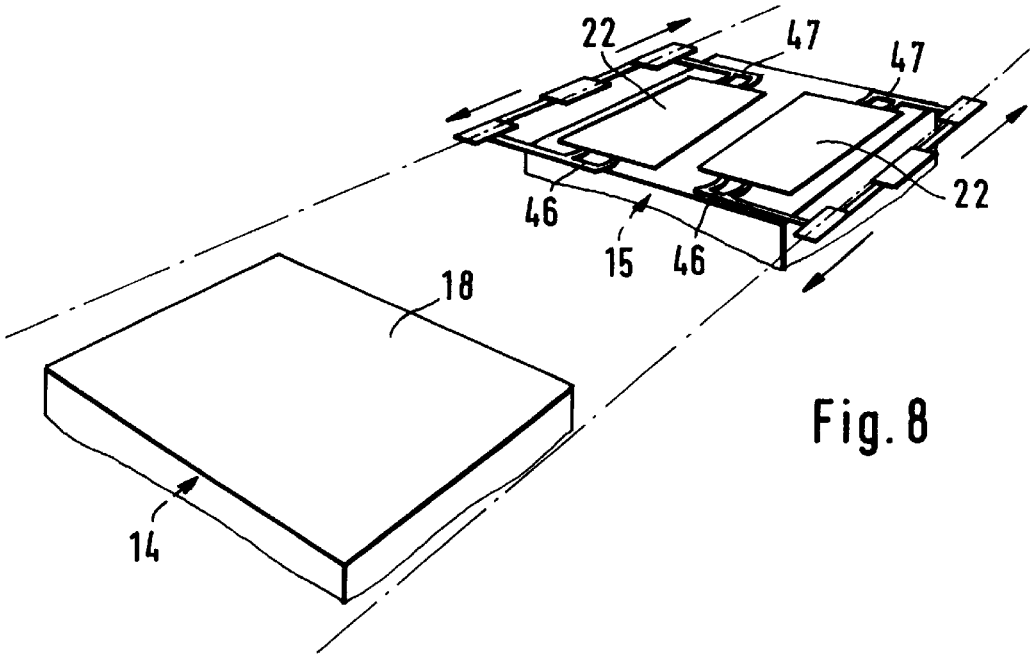

The next step begins the travel through the transfer curve K. For this purpose, the lifting units 26 to 29 are controlled such that the transfer carriers 24, 25 and thus the workpiece-receiving devices (extension arms 46, 47) carry out a vertical lift-out movement which is illustrated by arrows in FIG. 5. While this movement is still taking place, the transfer units 36, 37 are controlled such that a longitudinal movement is started as illustrated in FIG. 6. The extension arms 46, 47 and the workpiece carried by the arms 46, 47 now carry out a transfer movement during which the received workpiece is transported from tool 14 to tool 15. When, as illustrated in FIG. 7, the workpiece has arrived at tool 15, the longitudinal movement of the transfer drives 36, 37 stops and the lifting units 26 to 29 lower the transfer carriers 24, 25. As the result, the extension arms 46, 47 deposit the workpiece in the still open tool 15.

Even before point B is reached in FIG. 2, i.e., before the tools 14, 15 close, the adjusting drives 43 are controlled such that the extension arms 46, 47 are moved away from one another from the workpiece receiving position into the workpiece release position. As the result, the workpiece and the tool are released.

Figure 9:
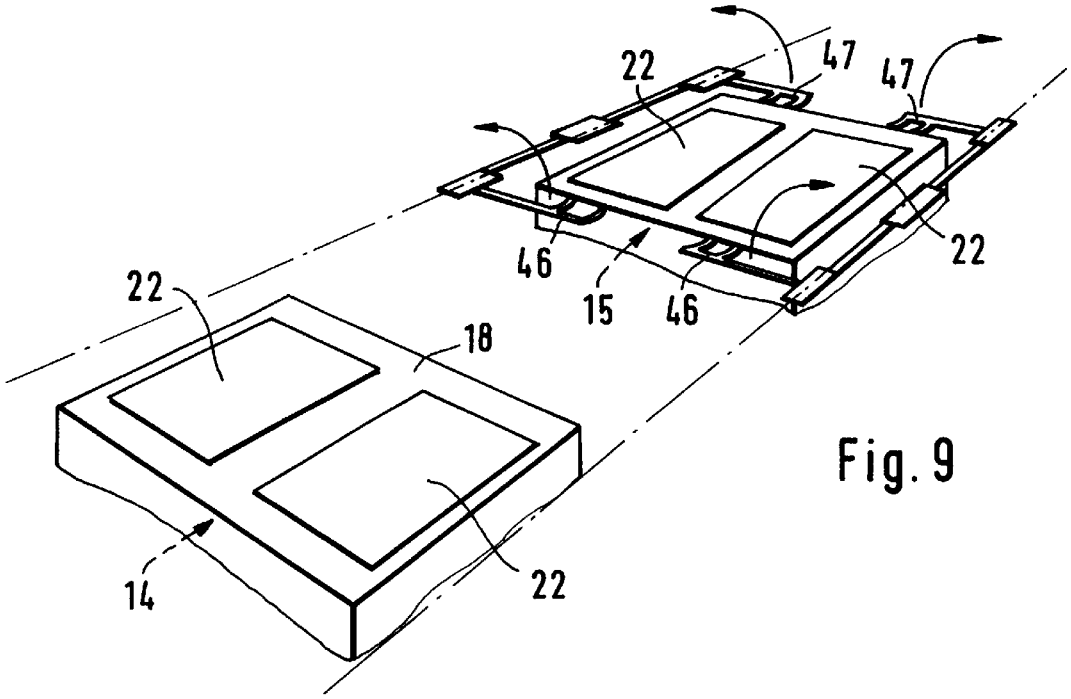
Figure 10:
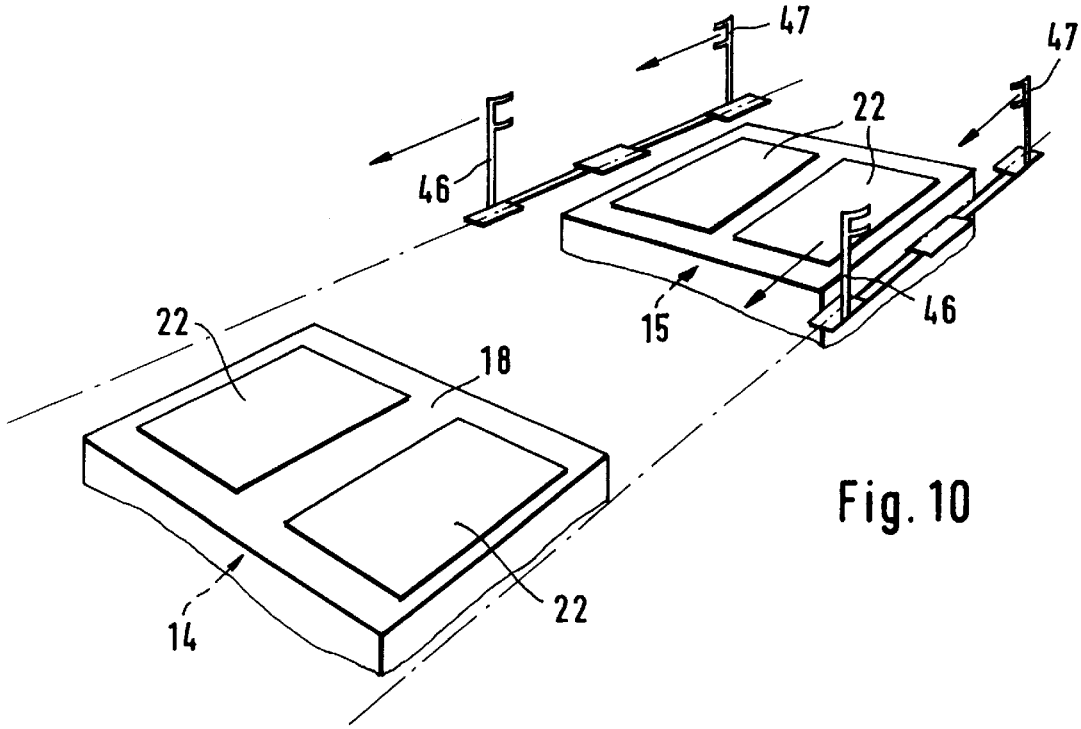
Figure 11:
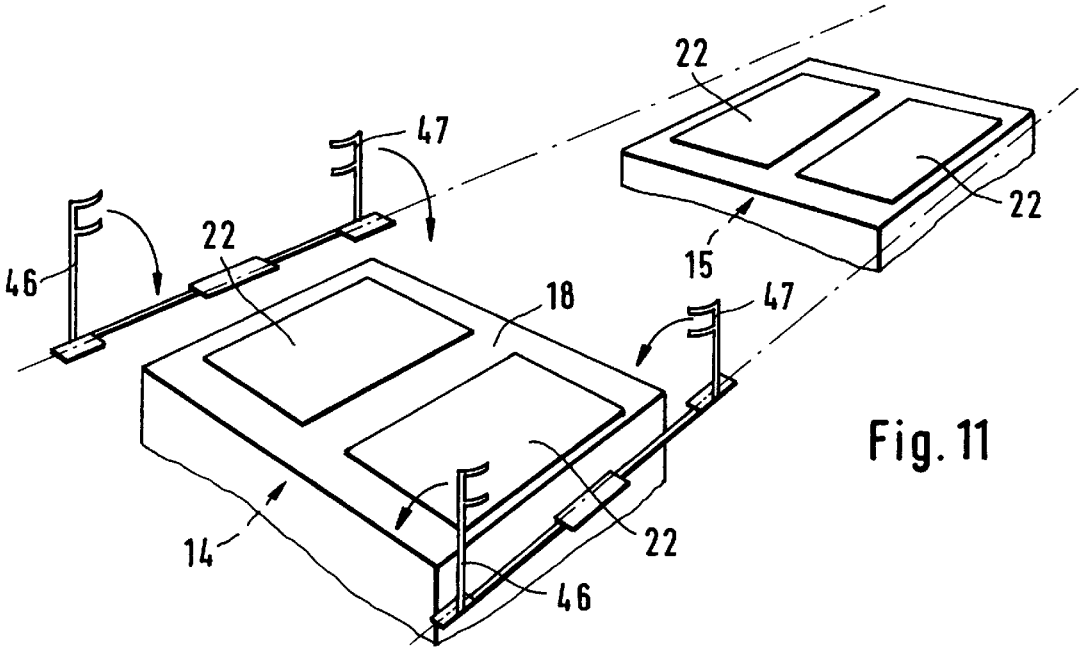

While the tools 14, 15 are closing and are closed, the swivel drives 44, 45 are controlled such that the extension arms 46, 47, as illustrated in FIG. 9, are swivelled from their horizontal position into the vertical position illustrated in FIG. 10. They are now situated in an overtaking position in which they can be moved past the closed tool 15 as well as the closed tool 14. By the corresponding control of the transfer drives 36, 37, the extension arms 46, 47 are therefore returned from tool 15 to tool 14 and, as illustrated in FIG. 11, are swivelled from their vertical position back into their horizontal position to read the initial position illustrated in FIG. 4.

As an alternative to the above-described embodiments, the swivel drives can act upon the transfer carriers 24, 25 and rotate these together by approximately 90° in order to swivel the transverse carriers 46, 47 from the horizontal line to the vertical line and back. As required, the transfer carriers 24, 25 can also be constructed as running rails which do not participate in the longitudinal component of the transfer movement but only guide the travelling carriages 41, 42.

The transfer system according to the present invention is provided for press facilities with several successive press stations. The transfer system 21 has divided cross traverses 46, 47 which, with respect to the transport direction, can be moved from the front and the rear into the tool 14, 15. Each tool 14, 15 includes two respectively transversely divided traverses 46, 47. For receiving and depositing the workpieces, the cross traverses 46, 47 are adjusted toward one another and away from one another. In addition, when the tool 14, 15 is closed, the cross traverses 46, 47 are moved laterally past the closed tool. As required, they may be moved into an overtaking position for this purpose, which can be carried out, for example, by a swivel drive 44, 45.

The transfer system 21 according to the invention permits a shortening of the minimum time for which the tools 14, 15 must be open with respect to the transfer system 21, and thus an increase of the stroke number of the press.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A transfer system for multi-station presses and press working lines, comprising:

at least one transfer carrier extending along at least two press stations; and workpiece-receiving devices moved along the transfer carrier in a transport direction and operatively arranged to receive and release only a front edge and only a rear edge of a workpiece in the transport direction to carry the workpiece from one station to another station and to release the workpiece at the other station, wherein the workpiece-receiving devices are arranged to be moved toward one another into a workpiece-receiving position, and away from one another into a workpiece-release position by moving the workpiece-receiving devices along the transfer carrier.

2. The transfer system according to claim 1, wherein the workpiece-receiving devices are arranged to be moved into an vertical position different from the workpiece-receiving position and the workpiece-release position, and to a position past the tool of a press station.

3. The transfer system according claim 1, wherein two mutually parallel transfer carriers are operatively arranged on both sides of the tools of the press stations.

4. The transfer system according to claim 1, wherein the transfer carrier is connected with a lifting unit for providing the transfer carrier with a vertical lifting and lowering movement.

5. The transfer system according to claim 1, wherein the at least one transfer carrier or travelling carriages disposed on the at least transfer carrier are connected with a transfer unit for a horizontal transfer movement with a maximal stroke at least as large as a center distance of two successive press stations.

6. The transfer system according to claim 5, wherein the workpiece receiving devices are connectable by controllable driving devices with the at least one transfer carrier.

7. The transfer system according to claim 1, wherein at least one adjusting drive is arranged on the at least one transfer carrier between the at least one transfer carrier and the workpiece-receiving devices for changing relative position between the respective workpiece-receiving device and the at least one transfer carrier.

8. The transfer system according to claim 7, wherein the at least one adjusting drive is operatively configured to provide the workpiece-receiving devices with an adjusting movement toward and away from one another.

9. The transfer system according to claim 8, wherein the at least one adjusting drive is configured to provide the workpiece-receiving devices with a transfer movement.

10. The transfer system according to claim 8, wherein the at least one adjusting drive is configured to change the workpiece-receiving devices from the work piece-release position into a vertical position.

11. The transfer system according to claim 1, wherein the at least one transfer carrier is operatively connected with a drive so as to be changeable into a position in which the workpiece-receiving devices are in a vertical position.

12. The transfer system according to claim 1, wherein the workpiece-receiving devices are provided, at least in the workpiece-receiving position thereof, with traverses extending transversely to a transfer direction and movable from the transverse direction into a vertical position.

13. The transfer system according to claim 12, wherein in the vertical position, the traverses are arranged to be movable, into the transfer direction.

14. The transfer system according to claim 13, wherein the traverses are movable into the transfer position by swivelling.

15. The transfer system according to claim 3, where the traverses are each operatively connected on an end side thereof with the at least one transfer carrier or travelling carriages disposed on the at least one transfer carrier, and the traverses are centrally divided.

16. The transfer system according to claim 12, where the traverses are each operatively connected on an end side thereof with the at least one transfer carrier or with travelling carriages disposed on the at least one transfer carrier, and the traverses are centrally divided.

17. The transfer system according to claim 1, where the workpiece-receiving devices have one of blades, grippers and suction devices for temporary holding and releasing of the workpieces.

18. A transfer system for multi-station presses and press working lines, comprising:

at least one transfer carrier extending along at least two press stations; and workpiece-receiving devices moved along the transfer carrier in a transport direction and are arranged to be moved toward one another into a workpiece-receiving position, and away from one another into a workpiece-release position to carry the workpiece from one station to another station and to release the workpiece at the other station, wherein the workpiece-receiving devices are operatively arranged to receive and release only a front edge and only a rear edge of a workpiece in the transport direction, wherein the workpiece-receiving devices are arranged to be moved into an vertical position different from the workpiece-receiving position and the workpiece-release position, and moved against the transport direction to a prior press station.

* * * * *